United States Patent [19]

Beyl

[11] 4,140,332

[45] Feb. 20, 1979

[54] HEEL HOLD-DOWN DEVICE FOR SAFETY SKI BINDING

[76] Inventor: Jean J. A. Beyl, 10, Boulevard Victor Hugo, Nevers, Nievre, France

[21] Appl. No.: 845,205

[22] Filed: Oct. 25, 1977

[30] Foreign Application Priority Data

Oct. 28, 1976 [FR] France ..... 76 32543

[51] Int. Cl.[2] ..... A63C 9/08

[52] U.S. Cl. ..... 280/626

[58] Field of Search ..... 280/626, 620

[56] References Cited

U.S. PATENT DOCUMENTS

| | | | |
|---|---|---|---|
| 3,249,365 | 5/1966 | Beyl | 280/626 |
| 3,970,326 | 7/1976 | Salomon | 280/626 |

*Primary Examiner*—Robert R. Song

*Attorney, Agent, or Firm*—Bierman & Bierman

[57] ABSTRACT

In a safety ski binding, a heel hold-down device has a heel retaining member urged by spring means to its heel retaining position and is pivotally mounted by means of a pair of lateral arms extending upwardly and rearwardly from a transverse horizontal axis, these lateral arms having their upper ends interconnected by a shaft extending through the retaining member, this shaft being rigid with a bow-shaped element of which the central section normally bears against the ski surface. Spring means constantly urge the retaining member to its inoperative position and may consist of a single steel wire coiled along lateral portions thereof formed with end loops slidably engaging the relevant lateral arms.

3 Claims, 3 Drawing Figures

HEEL HOLD-DOWN DEVICE FOR SAFETY SKI BINDING

BACKGROUND OF THE INVENTION

1. FIELD OF THE INVENTION

The present invention relates in general to safety ski bindings and has specific reference to heel hold-down devices adapted releasably to hold the heel portion of a ski boot against unnecessary movements on a ski or a base plate mounted thereon.

2. DESCRIPTION OF THE PRIOR ART

This invention is concerned more particularly with heel hold-down devices of the type wherein the heel retaining member is carried by a pair of lateral arms mounted for free pivotal movement about two horizontal axes. A heel hold-down device of this character is disclosed in my prior U.S. Pat. No. 3,249,365.

In this prior art device the heel retaining member is rotatably mounted about a horizontal transverse axis overlying the ski surface, behind the area normally occupied by the boot, and a spring-loaded mechanism constantly urges this member to the position enabling it to hold the heel of the ski boot against movement.

However, the arrangement is such that the boot heel can be lifted momentarily under normal skiing conditions. In this case, the lateral arms of the heel hold-down device pivot slightly upwards, but the spring-loaded mechanism controlling the retaining member subsequently restores the assembly to its initial position. Yet, in case of excessive effort due notably to a forward fall of the skier, the pivotal movement of the lateral arms continues until the retaining member escapes from the boot heel to release the boot completely.

To facilitate the initial operation consisting in positioning and locking the ski boot, locking means are provided as a rule for holding the retaining member of a heel hold-down device in its normal position. This locking system comprises a manually operable latch, for examples a bow-shaped member adapted to act as a stop member bearing against the ski surface. Besides, this latch is also capable of holding the retaining member of the heel ski binding against motion when transporting the skis.

However, the skier must necessarily be able to actuate this latch manually in order to bring same to its heel hold-down position. On the other hand, this latch must subsequently be retracted to permit the subsequent normal operation of the heel hold-down device. Now this retraction may if desired be controlled by the heel retaining member itself when the latter is in its operative or retaining position. However, in this case a particular arrangement of this member and an accurate adjustment of the position of the latch member are required, otherwise the latch member might fail from retracting to its non-interfering position, thus preventing the normal operation of the corresponding heel hold-down device.

DESCRIPTION OF THE INVENTION

To avoid these inconveniences, the present invention provides a heel hold-down device for a safety ski binding, of the general type set forth hereinabove, which is so designed that the retaining member is kept in its normally inoperative position without resorting to a latch member.

For this purpose, the base plate of the heel hold-down device according to this invention comprises on either side a spring anchored to the relevant lateral arm and so disposed as to constantly urge this lateral arm towards the ski surface, thus keeping the heel retaining member in its normal inoperative position.

According to an advantageous form of embodiment of the present invention the pair of springs thus contemplated consist each of a steel-wire torsion spring of which the end anchored to the relevant lateral arm of the heel hold-down device terminates with a loop or ring slidably surrounding said lateral arm.

Preferably, in this case the pair of springs consist of a single metal wire having a substantially U-shaped configuration with a central section extending transversely above the base plate of the heel hold-down device, the two lateral sections of the spring, which constitute the corresponding return springs, comprising a plurality of turns wound about a retaining lug or the like carried by the base plate of the heel hold-down device.

However, other features and advantages of the present heel hold-down device will appear as the following description proceeds with reference to the attached drawing illustrating diagrammatically by way of example, not of limitation, a typical form of embodiment of the invention.

DESCRIPTION OF THE PREFERRED EMBODIMENT

Figure 1:
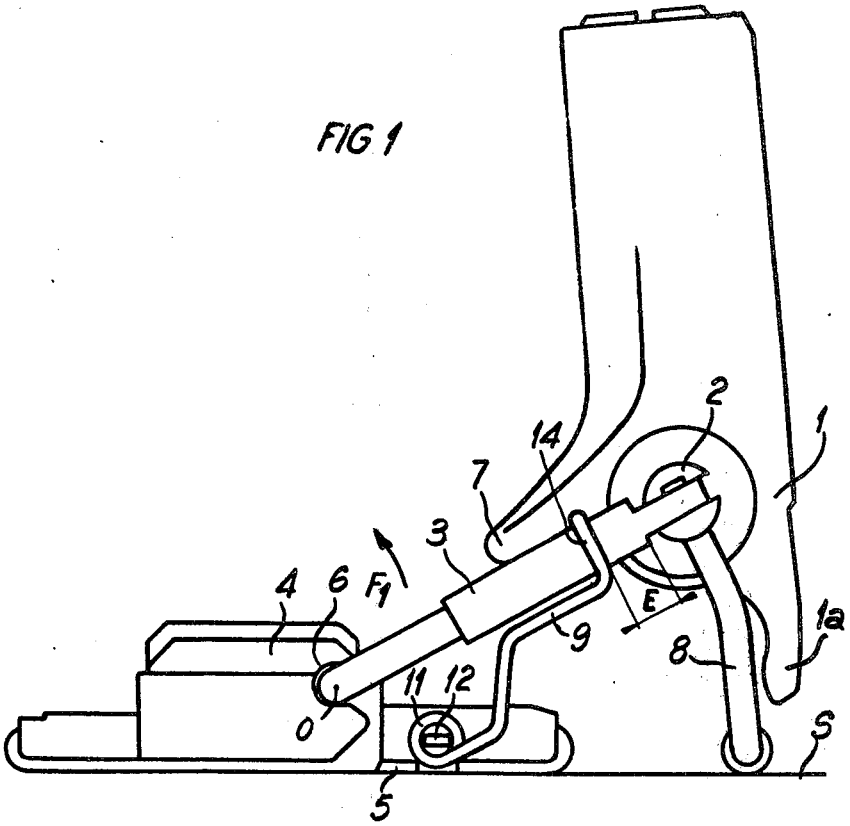
FIG. 1 is a side elevational view of the heel hold-down device of this invention, wherein the retaining member is shown in its normal inoperative position.
Figure 2:
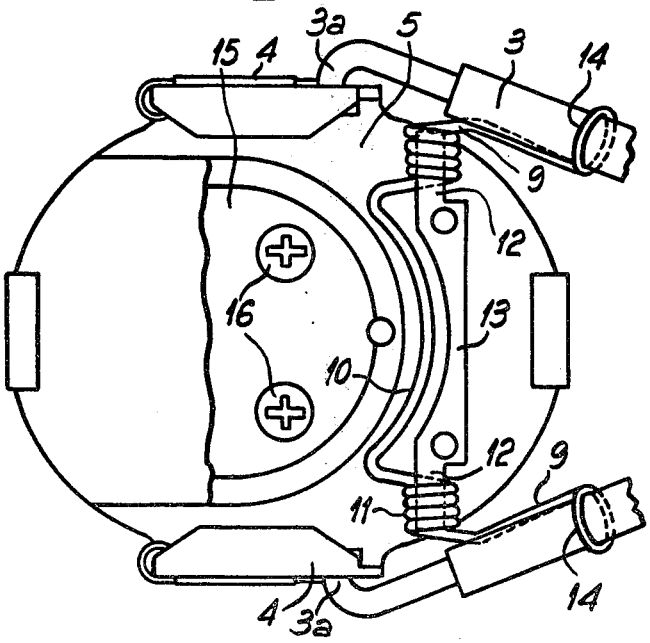
FIG. 2 is a plane view from about of the device, with parts broken away.

The heel hold-down device illustrated in the drawing is of the same type as that disclosed in the U.S. Pat. No. 3,249,365. In fact, this device comprises a retaining member 1 pivotally mounted about the axis of a transverse shaft 2 carried at its opposite ends by the rear ends of a pair of lateral arms 3. At their front ends, these lateral arms 3 are pivotally mounted in corresponding upstanding lateral lugs 4 carried by, or preferably formed integrally with, the base plate 5 of the device. The pivotal movements of arms 3 take place about an axis 0 which is the axis of the horizontal bent-in front portion 3*a* of each lateral arm 3 engaging a relevant hole 6 formed through the corresponding lug 4.

Thus, the pair of lateral arms 3 may pivot freely in a vertical direction towards or away from base plate 5. With this arrangement, the shaft 2 extends transversely behind the space to be occupied by the heel of the ski boot and is constantly parallel to base plate 5 and therefore to the top surface of the corresponding ski.

At the lower portion of its front surface the retaining member 1 comprises a holding beak 7 or a jaw adapted to bear against the top edge of the rear portion of the heel of a ski boot. A spring-loaded mechanism (not shown) constantly urges this retaining member to the angular position enabling it to hold the heel against movement on base plate 5 and therefore on the ski. This mechanism may be for example of the type disclosed in the said U.S. Pat. No. 3,249,365.

Besides, the shaft 2 of this retaining member 1 carries an inverted bow-shaped member 8 of which the central section extends downwards for abuting against the top surface of the relevant ski S when the retaining member 1 is in its normal inoperative position shown in FIG. 1.

However, according to an essential feature characterizing this invention, a spring 9 is disposed on either side of this heel hold-down device for resiliently urging the retaining member 1 into this position, said spring being attached on the one hand to base plate 5 and on the other hand to the corresponding lateral pivoting arm 3.

In the example illustrated the pair of springs 9 thus provided consist of a single metal wire 10 having a substantially U-shaped configuration with its intermediate section disposed transversely and close to base plate 5. The two lateral arms of this metal wire are inclined upwardly and rearwardly and constitute the springs proper. At their lower portions these arms constitute a series of turns 11 wound on lugs 12 or like members cut at either ends of a member 13 secured transversely to base plate 5.

At their rear or upper ends the two side arms 9 of metal wire 10 form each a loop 14 or a closed ring surrounding the corresponding lateral arm 3 with a certain clearance. Thus, each loop 14 may slide freely along the relevant arm 3.

Both spring-forming portions 9 are anchored with a certain degree of pre-stress to the corresponding lateral arms 3 when the central section of bow 8 bears against the top surface of the ski S. Therefore, the two springs constantly urge with a certain force the retaining member 1 to its normal inoperative position as illustrated in FIG. 1.

Figure 3:
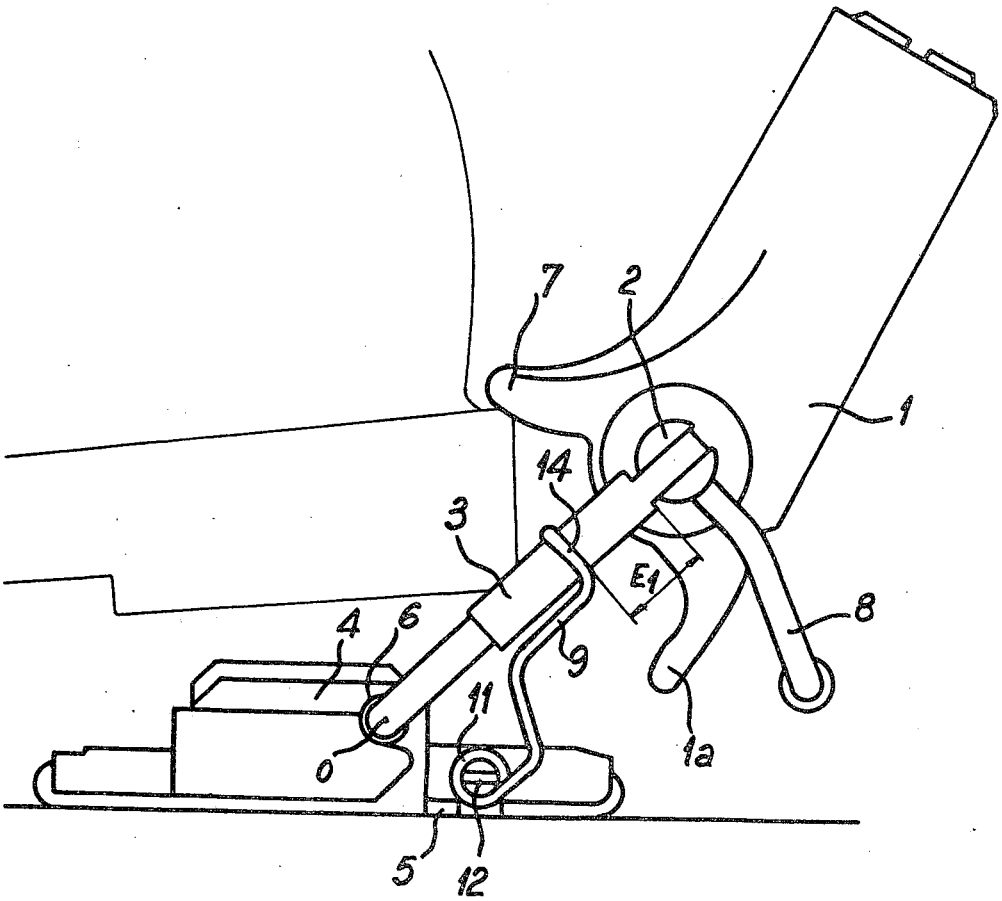
FIG. 3 is a view similar to FIG. 1 but showing the retaining member during a heel release movement.

When the side arms 3 of the heel hold-down device are caused to pivot upwardly in the direction of the arrow $F_1$ (FIG. 1) as a consequence of an extension stress exerted on the skier's leg, the loops 14 at the upper or rear ends of the pair of springs 9 are caused to slide along the corresponding arms. Thus, in the raised position illustrated in FIG. 3, these loops are located at a distance E1 from the rear end of arms 3, whereas in the normal inoperative position of member 1 they are located at a shorter distance E. However, this upward movement of arms 3 is also attended by a distortion of spring 9 which will subsequently tend to restore these two arms to their initial position, by pivoting in the direction opposite to that of arrow $F_1$.

Under these conditions, when the ski boot is released, both springs 9 restore the lateral arms 3 to their initial position as illustrated in FIG. 1, the lower end of bow 8 re-engaging the top surface of ski S. However, the retaining member 1 remains in its backward tilted position which is the position necessary for putting on the ski boot, so that the heel may resume its engagement with the heel hold-down device by bearing against the rear depending projection 1*a* of said retaining member in order to cause this member to pivot back to its operative position.

Due to the particular arrangement provided for this heel hold-down device, the movable component elements thereof are perfectly and safely held against motion and prevented from moving untimely when transporting the skis. Besides, the same component elements are also held against movement when fitting the ski boot initially in the binding, so that this operation is greatly facilitated.

Now these two results are obtained without requiring any particular manoeuvre from the user, in contrast with hitherto known heel hold-down devices of this type which comprise a manually-operated locking member or latch. The elimination of this latch is also advantageous in that it reduces the over-all dimensions of the heel hold-down device while avoiding the necessity of securing a complementary member to the ski, in addition to the base plate proper of the device.

In the example illustrated, this base plate consists of a hollowed member 5 rotatably mounted about a central disc 15 secured to the ski by means of screws 16. Preferably, means are also provided for holding the rotary plate 5 against rotation until the ski boot is fitted in position, these means being if desired those disclosed in my U.S. Pat. No. 4,077,653 issued Mar. 7, 1978, or in my copending application Ser. No. 831,242, filed Sept. 7, 1977.

However, the safety ski binding heel hold-down device according to this invention should not be construed as being limited by the use of a rotary plate, for it would not constitute a departure from the basic principles of the invention to provide simply a base plate secured directly to the top surface of the ski.

Besides, the heel hold-down device according to this invention is not limited by the specific form of embodiment shown in the attached drawing and described in the foregoing. Thus, instead of consisting of a single steel wire, the pair of springs 9 may be independent of each other. Moreover, these springs may be made if desired from spring blade stock or any other suitable material.

What I claim as new is:

1. A safety ski binding heel hold-down device comprising a base plate adapted to be secured to a ski, a pair of lateral arms extending on either side of the space allocated to the heel of a ski boot, means pivotally mounting the front ends of said arms on said base plate, a shaft interconnecting the rear ends of said lateral arms, a retaining member pivotally mounted on said shaft, said retaining member having a forwardly extending section adapted to engage the heel of the ski boot for urging the same toward said base plate, a member rigidly attached to and extending downwardly from said shaft toward the top surface of the ski in the normal position of the hold-down device, and spring means between said base plate and said lateral arms urging the latter toward said ski and thereby the lower end of said member against the top surface of said ski.

2. A safety ski binding heel hold-down device according to claim 1, in which said spring means comprise a pair of return spring arms each attached to one end to opposite transverse sides of said base plate, and at their respective other ends formed as a loop slidably surrounding the respective adjacent lateral arm.

3. A safety ski binding heel hold-down device according to claim 2, in combination with a pair of retaining lugs attached to said base plate, and in which the pair of return spring arms are formed of a single metal wire of substantially bow-shaped configuration with the central section of the bow extending transversely across said base plate with each arm section including several turns surrounding the respective lugs on said base plate to provide a return spring action.

* * * * *